US011219296B2

(12) United States Patent
Manici et al.

(10) Patent No.: US 11,219,296 B2
(45) Date of Patent: Jan. 11, 2022

(54) APPLICATOR FOR APPLYING A COSMETIC, MAKEUP OR CARE, PRODUCT TO THE EYELASHES AND/OR EYEBROWS

(71) Applicant: L'OREAL, Paris (FR)

(72) Inventors: Davide Manici, Mercenasco (IT); Eric Caulier, Ferrieres (FR); Alain Berhault, Clichy (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 462 days.

(21) Appl. No.: 15/518,114

(22) PCT Filed: Oct. 9, 2015

(86) PCT No.: PCT/EP2015/073475
§ 371 (c)(1),
(2) Date: Apr. 10, 2017

(87) PCT Pub. No.: WO2016/055649
PCT Pub. Date: Apr. 14, 2016

(65) Prior Publication Data

US 2017/0238678 A1 Aug. 24, 2017

(30) Foreign Application Priority Data

Oct. 10, 2014 (FR) ..... 1459749

(51) Int. Cl.
*A45D 40/26* (2006.01)
*A46B 9/02* (2006.01)
*A46B 3/04* (2006.01)

(52) U.S. Cl.
CPC ..... *A45D 40/267* (2013.01); *A46B 3/04* (2013.01); *A46B 9/021* (2013.01); *A46B 9/026* (2013.01);
(Continued)

(58) Field of Classification Search
CPC .. A45D 34/042; A45D 34/043; A45D 34/045; A45D 34/046; A45D 40/262;
(Continued)

(56) References Cited

U.S. PATENT DOCUMENTS

D632,487 S * 2/2011 Watanabe ..... D28/63
2001/0037815 A1 11/2001 Gueret
(Continued)

FOREIGN PATENT DOCUMENTS

EP 1 611 817 A1 1/2006
EP 1 767 119 A1 3/2007
(Continued)

OTHER PUBLICATIONS

Apr. 28, 2017 Third Party Observations issued in European Patent Application No. 15775736.0.
(Continued)

*Primary Examiner* — Yogesh P Patel
*Assistant Examiner* — Jennifer Gill
(74) *Attorney, Agent, or Firm* — Oliff PLC

(57) ABSTRACT

The present invention relates to an applicator (2) for applying a cosmetic, makeup or care product (P) to the eyelashes and/or eyebrows, having a moulded applicator member (8) having: —a core (10) that extends along a longitudinal axis (X), and —double spikes (18) that are carried by the core (10) and are disposed in a plurality of longitudinal rows, the double spikes (18) each having a recess that separates two arms, at least one first longitudinal row of spikes (18) being offset axially with respect to a second longitudinal row.

14 Claims, 2 Drawing Sheets

Figure 1:
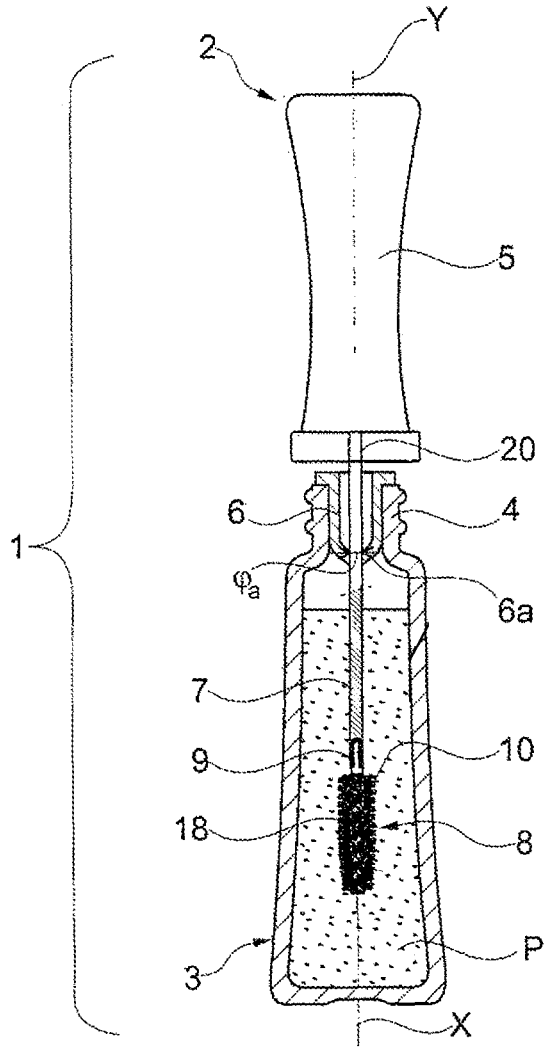

(52) U.S. Cl.
CPC ..... *A46B 9/028* (2013.01); *A46B 2200/1053* (2013.01)

(58) Field of Classification Search
CPC ..... A45D 40/267; A46B 2200/1046; A46B 2200/1053; A46B 3/04; A46B 9/021; A46B 9/026; A46B 9/028; A46D 1/0238; A46D 1/0253
USPC ..... D4/136; 132/218, 313, 320; 15/187–188
See application file for complete search history.

(56) References Cited

U.S. PATENT DOCUMENTS

| | | | | |
|---|---|---|---|---|
| 2006/0002758 | A1* | 1/2006 | Gueret | A45D 40/265 401/122 |
| 2007/0062551 | A1* | 3/2007 | De Brouwer e | A45D 34/045 132/218 |
| 2007/0062552 | A1 | 3/2007 | De Brouwer et al. | |
| 2009/0193602 | A1* | 8/2009 | Dumler | A46B 3/005 15/160 |
| 2012/0103361 | A1* | 5/2012 | Geuther | A45D 40/26 132/218 |
| 2016/0022012 | A1* | 1/2016 | Jacob | A45D 40/265 401/129 |

FOREIGN PATENT DOCUMENTS

| | | | |
|---|---|---|---|
| EP | 2 281 478 | A2 | 2/2011 |
| WO | 01/05273 | A1 | 1/2001 |
| WO | 2006/090343 | A1 | 8/2006 |

OTHER PUBLICATIONS

Dec. 7, 2015 International Search Report issued in International Patent Application No. PCT/EP2015/073475.
Jul. 19, 2016 Third Party Observation filed in International Patent Application No. PCT/EP2015/073475.

* cited by examiner

APPLICATOR FOR APPLYING A COSMETIC, MAKEUP OR CARE, PRODUCT TO THE EYELASHES AND/OR EYEBROWS

The present invention relates to an applicator for applying a cosmetic, makeup care product to the eyelashes and/or eyebrows, for example mascara.

The invention also relates to devices having a container which contains the product to be applied and is preferably provided with a wiping member, and the applicator.

Applicators having double spikes are known from applications US 2007/0062552 and US 2007/0062551.

There is a need to further improve applicators for applying a product, in particular mascara, to the eyelashes and/or eyebrows, in order to improve the performance thereof, and more particularly to promote the creation on the applicator member of zones that are more heavily laden with product, which allow easy application of makeup and rapid and abundant loading of the eyelashes and/or eyebrows, while retaining a satisfactory capacity to separate the latter.

The invention aims to meet this objective and the subject thereof, according to one of its aspects, is an applicator for applying a cosmetic, makeup or care product to the eyelashes and/or eyebrows, having a moulded applicator member having:

a core that extends along a longitudinal axis, and double spikes that are carried by the core and are disposed in a plurality of longitudinal rows, the double spikes each having a recess that separates two arms, at least one first longitudinal row of double spikes being offset axially with respect to a second longitudinal row of double spikes.

The invention makes it possible to obtain, on the applicator member, in particular in the relatively large space created by the recess between the two arms of each double spike, at least one zone that forms a reservoir, little of the contents of said zone being emptied during the extraction of the applicator, thus providing a surplus of product along the entire length of the core and on all sides after wiping. This surplus of product allows the eyelashes and/or eyebrows to be loaded with a large and satisfactory amount of product from the first application.

During application of makeup, the spaces created between the two arms of the double spikes axe emptied gradually of their contents, in particular by virtue of the eyelashes and/or eyebrows penetrating into them. The latter are thus properly covered with product without the user having to frequently reload the applicator by reintroducing it into the container. Moreover, although the load of product is large, the applicator according to the invention makes it possible to separate the eyelashes and/or eyebrows, avoiding the formation of clumps, by virtue of the axial offset between the longitudinal rows of double spikes.

The eyelashes and/or eyebrows can also be curled satisfactorily, since the latter are positioned between the arms of the double spikes, at the base of the recess in the double spikes.

The depth of the recess in the double spikes can be varied during manufacturing in order to adjust the level to which the applicator is loaded with product after wiping.

The expression "longitudinal axis of the core" denotes the line connecting all of the centres of mass of the cross sections of the core. The longitudinal axis may be a central axis, or even an axis of symmetry for the core, in particular when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

The term "spike" denotes an individualizable projecting element intended to come into engagement with the eyelashes and/or eyebrows.

The expression "axially offset longitudinal rows" should be understood as meaning that the double spikes of the same rank in these rows do not occupy the same position along the longitudinal axis of the core.

Core and Spikes

The spacing between the two arms of a double spike, measured perpendicularly to the elongation axis of the spike, between the median planes of each arm, half-way down the recess, is advantageously between 1 mm and 2.5 mm, and in particular equal to 1.7 mm. The expression "elongation axis of the spike" denotes an axis which passes through the centres of mass of the cross sections of the spike.

The two arms of a double spike are preferably the same length. In one variant, the two arms of a double spike are of different lengths.

The height of the double spikes may be between 1 mm and 4 mm, better still between 1.5 mm and 3.25 mm. The expression "height of a double spike" denotes the distance measured along the elongation axis of the double spike between the free end of the higher arm and the base of the double spike by way of which it is connected to the core.

The depth of the recess in each double spike is preferably less than the height of the higher arm of said spike.

The expression "depth of the recess" denotes the distance measured along the elongation axis of the double spike between the free end of the higher arm of the spike and the bottom of the recess.

The ratio between the depth of the recess in a spike and the height of said spike may be between 0.09 and 0.35, better still between 0.11 and 0.3.

The depth of the recess in the double spikes is preferably between 0.5 mm and 2.5 mm, better still between 0.7 mm and 2 mm.

The height of the base of a double spike, measured along the elongation axis of the spike, between the bottom of the recess and the point at which said base is attached to the core, may be between 0.5 mm and 4 mm, better still between 0.8 mm and 2.75 mm. The base of the double spikes, of non-zero height, that is situated between the core and the recess, makes it possible to push away the wiping lip and to keep the product on the core, between the rows of double spikes and around the latter.

The ratio between the diameter of the circumscribed circle that has as its centre the longitudinal axis of the core and passes through the tops of the bases of greatest height, in cross section perpendicular to the longitudinal axis of the core, and the diameter of the orifice defined by the lip of the wiping member may be between 0.75 and 1.15.

Preferably, the height of the double spikes varies, for example in a monotonous manlier, along the longitudinal axis of the core. The height of the double spikes in a longitudinal row advantageously decreases in the direction of the distal end of the core, in particular along at least half the length of the applicator member. In one variant, the height of the double spikes is constant along the longitudinal axis of the core.

Within one longitudinal row of double spikes of varying height, the arms of all the spikes may be the same length and it is the height of the base that varies and brings about a variation in the height of the spikes.

Thus, the depth of the recesses in the spikes can be constant along a row.

In a variant, this depth varies, for example along less than half the length of the applicator member.

The free ends of the arms of the spikes of the applicator member define an envelope surface of the applicator member, which is for example in the form of a cylinder of revolution along at least a part of its length.

The envelope surface may have a largest transverse dimension that is substantially constant along at least a part of the length of the applicator member, in particular along more than half the part of the core that carries the double spikes.

The envelope surface may also have a cross section that varies along all or part of the length of the applicator member. The cross section of the envelope surface may for example have one or more extremes and for example at least one local minimum and two local maxima. The diameter of the envelope surface that passes through the tops of the arms of the spikes of smallest height may be between 3.75 mm and 7.5 mm, and is in particular equal to around 5 mm. The diameter of the envelope surface of the applicator member that passes through the tops of the arms of the spikes of greatest height may be between 5 mm and 11 mm, and is for example equal to around 7.7 mm.

The recess in each spike may have a flat bottom. In one variant, the recess in the spikes has a rounded bottom, in particular concave towards the free end of the arms.

At least one double spike may extend from the core along an elongation axis perpendicular to the surface of the core at the point at which the spike is attached to the core. Preferably, the double spikes each extend from the core along an elongation axis perpendicular to the surface of the core at the point at which the spikes are attached to the core.

In a variant, the elongation axis of the double spikes foods an angle other than 90° with the surface of the core at the point at which the spikes are attached to the core.

The double spikes may have a flattened cross section, that is to say that they have, over at least a part of their height, in particular at their base, a cross section, taken perpendicularly to their direction of elongation, which has an elongate shape in a flattening plane, being wider than it is thick. The flattening plane of the spikes may form a zero angle with the longitudinal axis of the core, the double spikes being advantageously oriented longitudinally along the applicator member with a median plane containing the longitudinal axis of the core. In one variant, the flattening plane of the spikes forms an angle of between 25° and 80° with the longitudinal axis of the core.

Some double spikes on the applicator, or even all of the double spikes, may have a thickness of between 0.2 mm and 1.1 mm, better still between 0.3 mm and 0.7 mm, said thickness being in particular equal to around 0.5 mm. The expression "thickness of a spike" denotes the largest transverse dimension of the spike, in section, perpendicularly to the elongation axis of the spike.

Some double spikes on the applicator, or even all of the double spikes, may have a width of between 1.1 mm and 3 mm, better still between 1.6 mm and 2.5 mm, said width being in particular equal to around 2.2 mm.

The arms of each double spike are preferably symmetrical to one another about a median plane of the spike, containing its elongation axis. In one variant, the arms of one and the same double spike are non-symmetrical about the median plane of the spike, and have in particular different lengths.

The arms of the double spikes may have any shape. The arms may have a cylindrical or tapered, in particular conical, semi-conical, frustoconical or pyramidal shape, in particular with a hexagonal base. The arms of the spikes may have an asymmetric shape, each having a first face that has a first, in particular flat, shape, and a second face that has a second, for example non-flat, in particular rounded, shape.

The arms of the double spikes are advantageously rectilinear.

The cross section of the double spikes at their base preferably has an approximately rectangular shape.

At least one arm of a spike may be ended by a rounded, in particular hemispherical, free end, the radius of which may be between 0.06 mm and 0.2 mm, and is in particular equal to around 0.15 mm.

The longitudinal rows of spikes are advantageously rectilinear.

Each longitudinal row of spikes is preferably offset axially with respect to the consecutive longitudinal row.

The double spikes in every other longitudinal row may all be at the same axial position along the longitudinal axis of the core.

The number of longitudinal rows may be even.

The axial offset between one longitudinal row of spikes and the consecutive longitudinal row is advantageously between one quarter and three quarters of the width of a double spike, and is in particular equal to around two fifths of the width of a double spike.

Within one and the same longitudinal row, the spacing between two double spikes of ranks n and n+1, measured along the longitudinal axis of the row, between the two facing arms of these two consecutive double spikes, may be between 0.5 mm and 2.5 mm, better still between 1 mm and 2 mm, and is in particular equal to around 1.2 mm.

The core may have a cross section, taken perpendicularly to its longitudinal axis, with any, in particular a circular, shape. The largest cross section of the core, namely its diameter in the case in which the cross section of the core has a circular shape, may be between 1.5 mm and 3.2 mm, and is in particular equal to around 2.9 mm.

The core and the double spikes may be moulded from one and the same material, or in a variant they can be made from at least two different materials. In implementation examples of the invention, the double spikes are produced by overmoulding on the core.

The core and/or the double spikes are preferably produced from a thermoplastic material.

Applicator

The applicator may have a stem that carries the applicator member at a first end and is fixed to a gripping member at a second end.

The core may be solid, being for example moulded with an end piece for fixing to the stem of the applicator.

The applicator member may be fixed to the stem by snap-fastening, adhesive bonding, welding, crimping, pressing, stapling, force-fitting, fitting in a cold state or fitting in a hot state, for example by an end piece of the applicator member being mounted in a housing in the stem. In a variant, the stem is received in a housing provided in the core.

It is also possible for the stem and the applicator member to be moulded or not to be moulded in one piece and from the same thermoplastic material.

The double spikes may be made of a material that is more or less rigid than a material used to produce the stem of the applicator to which the core is attached.

The core may extend along a longitudinal axis which, at at least one point along its length, forms a non-zero angle with the longitudinal axis of the stem to which the core is fixed. The applicator member may be angled at its attachment to the stem.

The stem may have a first, rigid portion that is extended on the distal side by a second, more flexible portion, for example made of elastomer, that carries the applicator member.

The visible length of the applicator member may be between 15 mm and 35 mm, better still between 22 mm and 29 mm, and is for example equal to around 24.5 mm.

The applicator may have between 60 and 240 double spikes, for example between 84 and 168 double spikes.

The first double spike along the longitudinal axis of the core starting from the stem may be disposed at a non-zero distance from the proximal end of the core, in particular between 0.2 mm and 0.5 mm. The last double spike along the longitudinal axis of the core starting from the stem may be disposed at a non-zero distance from the distal end of the core, in particular between 0.3 mm and 0.8 mm.

Application Device

A further subject of the invention is a device for packaging and applying a product to the eyelashes and/or eyebrows, having an applicator according to the invention, as defined above, and a container containing the product to be applied.

The gripping member of the applicator may form a cap for closing the container.

The container may have a wiping member suitable for wiping the stem and the applicator member.

The product is preferably a mascara.

Figure 2:
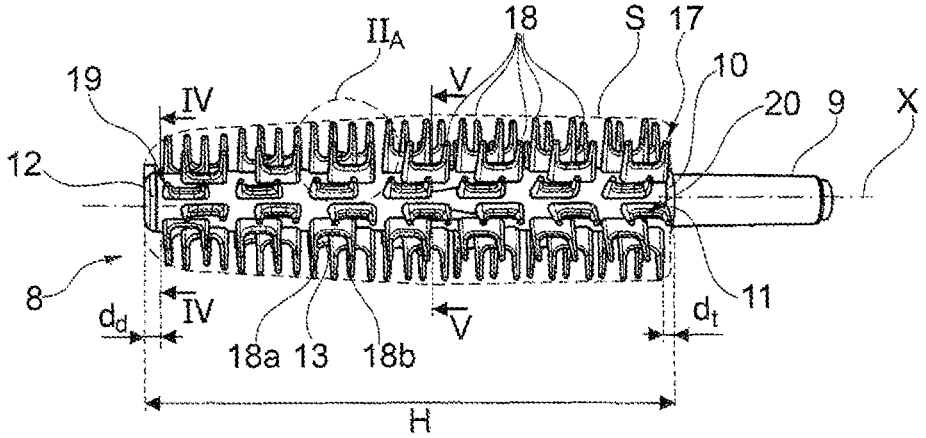
Figure 2A:
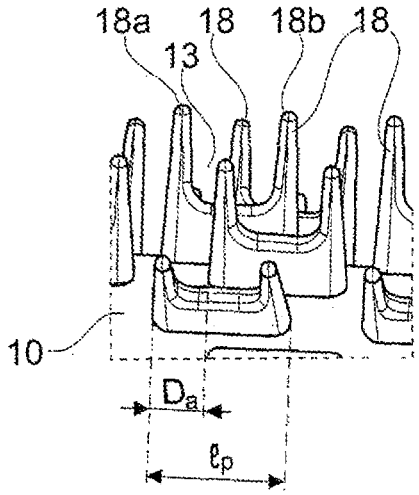
Figure 3:
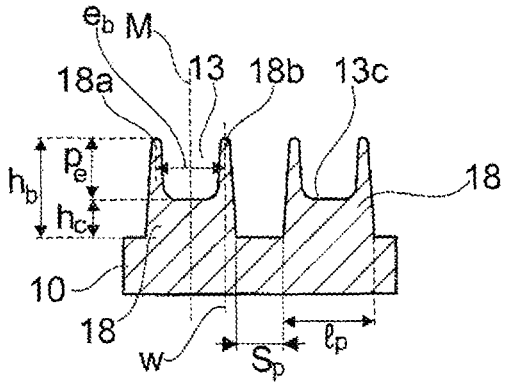
Figure 4:
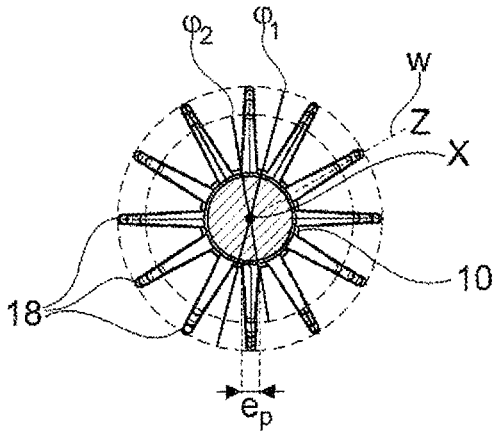
Figure 5:
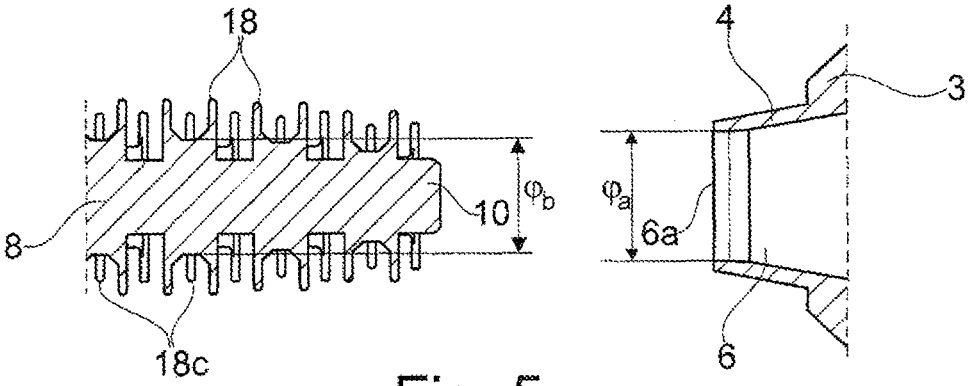

The invention may be better understood from reading the following detailed description of a non-limiting implementation example thereof, and with reference to the attached drawing, in which:

FIG. 1 is a schematic elevation view, in partial longitudinal section, of an exemplary packaging and application device produced in accordance with the invention, FIG. 2 shows a perspective view of the applicator member from FIG. 1 on its own, FIG. 2A shows a detail of the applicator member from FIG. 2, FIG. 3 is a view in longitudinal section of a detail of the applicator member from FIG. 2, FIG. 4 is a section along IV-IV of the applicator member from FIG. 2, and FIG. 5 illustrates the extraction of the applicator member from the container of the packaging and application device from FIG. 1.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also forming a gripping member for the applicator 2.

The latter has a stem 7 of longitudinal axis Y, which is attached at its upper end to the closure cap 5 and at its lower end to an applicator member 8. The latter has a core 10 that carries double spikes 18 that extend from the core 10 and all around the latter. As can be seen in FIG. 2, the first double spike 18 along the longitudinal axis X of the core 10 starting from the stem 7 is disposed at a non-zero distance $d_t$ from the proximal end 11 of the core, for example equal to around 0.35 mm. The last double spike 18 along the longitudinal axis X of the core 10 starting from the stem 7 is disposed at a non-zero distance $d_d$ from the distal end 12 of the core 10, for example equal to around 0.55 mm.

The container 3 also has a wiping member 6, inserted into the neck 4.

This wiping member 6, which may be of any suitable type, has, in the example in question, a lip designed to wipe the stem 7 and the applicator member 8 when the applicator 2 is withdrawn from the container 3. The lip defines a wiping orifice 6*a* having a diameter $\varphi_a$ adapted to that of the stem 7. The wiping member 6 may be made of elastomer. The wiping orifice 6*a* has for example a circular shape.

The diameter $\varphi_a$ of the wiping orifice 6*a* is typically between 3 and 5.75 mm, and is for example around 4.5 mm or 5.2 mm.

In the example illustrated, the stem 7 has a circular cross section, but if the stem 7 has some other section, this does not depart from the scope of the present invention, it then being possible to fix the cap 5 on the container 3 in some other way than by screwing, if necessary. The wiping member 6 is adapted to the shape of the stem 7 and to that of the applicator member 8, if appropriate.

Preferably, and as in the example in question, the longitudinal axis Y of the stem 7 is rectilinear and coincident with the longitudinal axis of the container 3 when the applicator 2 is in place thereon, but if the stem 7 is not rectilinear, forming for example an elbow, this does not depart from the scope of the present invention.

If need be, the stem 7 may have an annular narrowing at its portion that is positioned opposite the lip of the wiping member 6, so as not to mechanically stress the latter unduly during storage.

As illustrated in FIG. 2, the applicator member 8 may have an end piece 9 for fixing it in a corresponding housing in the stem 7.

The applicator member 8 may be fixed to the stem 7 by any means, and in particular by force-fitting, snap-fastening, adhesive bonding, welding, stapling or crimping, in this housing.

With reference to FIG. 2, it can be seen that the core 10 has a shape that is elongate along a longitudinal axis X, which is rectilinear in the example described. The longitudinal axis X may be central, as illustrated.

The visible length H of the applicator member 8 is for example equal to 24.5 mm.

In the example illustrated, the double spikes 18 each extend from the core 10 along an elongation axis W perpendicular to the surface of the core at the point at which the spike 18 is attached to the core 10.

As can be seen in particular in FIG. 3, the double spikes 18 each have a recess 13 that separates two arms 18*a* and 18*b*.

The spacing $e_b$ between the two arms 18*a* and 18*b* of the spikes 18 may be between 1 mm and 2.5 mm, and is equal to around 1.7 mm in the example in question.

The two arms 18*a* and 18*b* of one and the same spike 18 are the same height in the example described.

As can be seen in FIG. 2, the height $h_b$ of the double spikes 18 may vary along the longitudinal axis X of the core 10. The height $h_b$ may decrease towards the distal end 12 of the core 10, so as to facilitate insertion into the container 3. This height $h_r$, may be between 0.5 mm and 4 mm, better still between 0.8 mm and 2.75 mm.

With reference to FIG. 4, the diameter $\varphi_2$ of the envelope surface formed by the arms of spikes 18 of smallest height may be between 3.75 mm and 7.5 mm, and is for example equal to around 5 mm. The diameter $\varphi_1$ of the envelope surface of the applicator member 8 formed by the arms of spikes 18 of greatest height may be between 5 mm and 11 mm, and is for example equal to around 7.7 mm.

The depth $P_e$ of the recess 13 in each spike 18 is advantageously less than the height $h_b$ of said spike 18, as can be seen in particular in FIG. 3.

The ratio $P_e/h_b$ between the depth $P_e$ of the recess 13 in a spike 18 and the height $h_b$ of said spike 18 may be between 0.09 and 0.35, better still between around 0.11 and 0.3.

The depth $P_e$ of the recess 13 in each double spike 18 may be between 0.5 mm and 2.5 mm, better still between 0.7 mm and 2 mm.

In the example illustrated, the recess 13 in each double spike 18 has a flat bottom. However, the invention is not limited to one particular shape of recess.

The double spikes 18 each have, as illustrated, a base 18*c* that connects their two arms 18*a* and 18*b* and projects from the core 10. The height of the base 18*c* of a double spike 18 may be between 0.2 mm and 2.25 mm, better still between 0.3 mm and 1.6 mm.

The ratio between the diameter of the circumscribed circle that has as its centre the longitudinal axis X of the core 10 and passes through the tops of the bases 180 of greatest height and the diameter $\varphi_a$ of the orifice 6*a* in the wiping member 6, these being visible in. FIG. 5, may be between 0.75 and 1.15.

In the example in question, the double spikes 18 have a cross section flattened along a flattening plane Z containing the longitudinal axis X of the core 10.

The double spikes 18 may narrow, in side view, in the direction of their free end 28, as can be seen in particular in FIG. 4.

The thickness $e_p$ of the double spikes 18 may be between 0.3 mm and 0.85 mm, and is for example equal to around 0.5 mm, as in the example in question.

The width $l_p$ of a double spike 18 may be between 1.3 mm and 3 mm, and is for example equal to around 2.2 mm.

In the example described, the double spikes 18 are disposed on the applicator member 8 in a plurality of rectilinear longitudinal rows 17, 19, 20, as can be seen in particular in FIG. 2, each longitudinal row 17 of spikes being offset axially with respect to the adjacent longitudinal rows 19.

The double spikes 18 in every other longitudinal row advantageously all occupy the same axial position along the longitudinal axis X of the core 10, as illustrated in FIG. 2, for example between the longitudinal rows 17 and 20.

The axial offset $D_a$ between one longitudinal row 17 of double spikes 18 and the adjacent longitudinal row 19 is advantageously between one quarter and three quarters of the width $l_p$ of a spike 18, and is approximately equal to two fifths of the width $l_p$ in the example described, as can be seen in particular in FIG. 2A.

Within one and the same longitudinal row 17, the spacing $S_p$ between two consecutive spikes 18 may be between 1 mm and 2 mm, and is for example equal to 1.2 mm, as in the example described.

The spikes 18 may have various shapes. In the example in question, and as can be seen in particular in FIG. 4, the arms of the double spikes 18 have a conical shape. The arms 18*a* and 18*b* of each double spike 18 are symmetrical to one another about the median plane M of the spike 18. Each double spike 18 can also have a symmetrical shape about its flattening plane Z.

In the example in question, the free ends 28 of the double spikes 18 define an envelope surface S of the applicator member 8, having a rectilinear longitudinal axis that is coincident with the longitudinal axis X of the core 10, and is rotationally symmetrical about said axis X.

The double spikes 18 are made, in the example in question, in one piece with the core 10 by moulding thermoplastic material.

In order to mould the applicator member 8, use can be made of any thermoplastic material which is or is not relatively rigid, for example SESS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible in particular to use the materials known under the trade names Teflon®, Hytrel®, Cariflex®, Alixine®, Santoprene®, Pebax® and Pollobas®, this list not being limiting.

In order to use the device 1, the user unscrews the closure cap 5 and withdraws the applicator member 8 from the container 3.

Once the applicator member 8 has passed through the wiping member 6, a particular quantity of product P remains in the spaces created between the arms of the double spikes 8 and between their bases, creating reservoirs of product along the entire length of the core 10 and on all sides, making it possible to load the eyelashes and/or eyebrows with product P in a satisfactory manner. Moreover, the eyelashes and/or eyebrows are separated in a satisfactory manner, avoiding the formation of clumps, by virtue of the axial offset present between the longitudinal rows of adjacent double spikes 18. The eyelashes and/or eyebrows are also curled in a satisfactory manner, since the latter can press against the base of the recesses 13 in the spikes 18.

Of course, the invention is not limited to the exemplary embodiment which has just been described.

The applicator member 8 may be able to vibrate, that is to say that it is possible to apply vibrations thereto during application, combing or picking up of the product P, for example as described in the application WO 2006/090343.

In a further variant, the applicator member 8 may be able to rotate, that is to say that it may be made to carry out a rotational movement about the longitudinal axis X of the core 10, for example during application, combing or picking up of the product P.

In a further variant, the applicator member 8 may be heated, that is to say have a heating element for heating the keratin fibres, the eyelashes and/or eyebrows, and/or the spikes 18 and/or the core 10 of the applicator member 8.

It is also possible for the applicator member 8 to be able to vibrate, to be able to rotate and to be heated, or only to be able to vibrate and to be able to rotate, or only to be able to vibrate and to be heated, or only to be able to rotate and to be heated, or only to be able to vibrate or only to be able to rotate or only to be heated.

The applicator member 8 may comprise any bactericidal agent such as silver salts, copper salts, preservatives and at least one preservative for the product P.

The core 10 and/or the double spikes 18 may, furthermore, comprise particles, for example a filler, in particular a compound which is magnetic, bacteriostatic or absorbs moisture, or else a compound intended to produce roughness on the surface of the spikes 18 or to help the eyelashes and/or eyebrows to slide on the spikes. At least one of the core 10 and a double spike 18 may be flocked, or undergo any heat or mechanical treatment.

The expression "having a" should be understood as being synonymous with "comprising at least one", and "between" is understood as including the limits, unless specified to the contrary.

The invention claimed is:

1. An applicator for applying a cosmetic, makeup or care product to the eyelashes and/or eyebrows, the applicator comprising a moulded applicator member having:

a core that extends along a longitudinal axis, and double spikes that are carried by the core, the double spikes extending from and all around the core, and the double spikes are disposed in a plurality of longitudinal rows, the double spikes each having a recess that separates two arms, and a base of non-zero height that connects their two arms together and projects from the core, a spacing between the two arms of each of the double spikes being between 1 mm and 2.5 mm, each longitudinal row of double spikes of said plurality of longitudinal rows being offset axially with respect to an adjacent longitudinal row of said plurality of longitudinal rows, the double spikes of the same axial rank in every other longitudinal row of said plurality of longitudinal rows occupy the same axial position along the longitudinal axis of the core, the axial offset between adjacent rows of the plurality of longitudinal rows of double spikes being between one quarter and three quarters of a width of a double spike of the plurality of double spikes, and the spacing between two consecutive double spikes being greater than said axial offset between adjacent rows of the plurality of longitudinal rows of double spikes.

2. An applicator for applying a cosmetic, makeup or care product to the eyelashes and/or eyebrows, the applicator comprising a moulded applicator member having:

a core that extends along a longitudinal axis, and double spikes that are carried by the core, the double spikes extending from and all around the core, and the double spikes are disposed in a plurality of longitudinal rows, the double spikes each having a recess that separates two arms, and a base of non-zero height that connects their two arms together and projects from the core, a spacing between the two arms of each of the double spikes being between 1 mm and 2.5 mm, each longitudinal row of double spikes of said plurality of longitudinal rows being offset axially with respect to an adjacent longitudinal row of said plurality of longitudinal rows, the double spikes of the same axial rank in every other longitudinal row of said plurality of longitudinal rows occupy the same axial position along the longitudinal axis of the core, the axial offset between adjacent rows of the plurality of rows of double spikes being between one quarter and three quarters of the width of a double spike of the plurality of double spikes, and the height of the double spikes in a longitudinal row decreases in the direction of the distal end of the core, along at least half the length of the applicator member.

3. The applicator according to claim 1, wherein a depth of the recess in each double spike is between 0.5 mm and 2.5 mm.

4. The applicator according to claim 1, wherein the recess of the double spikes has a depth, and a ratio $P_e/h_b$ between the depth of the recess in the double spikes and the height of the double spikes is between 0.09 and 0.35.

5. The applicator according to claim 1, wherein a height of the base that connects the two arms of the double spikes together and projects from the core is between 0.2 mm and 2.25 mm.

6. The applicator according to claim 1, wherein the recess in each double spike has a flat bottom.

7. The applicator according to claim 1, wherein the arms of each double spike are symmetrical to one another about a median plane of the double spike.

8. The applicator according to claim 1, wherein the double spikes are oriented longitudinally on the applicator member with a median plane containing the longitudinal axis of the core.

9. The applicator according to claim 1, wherein the longitudinal rows of said plurality of longitudinal rows are rectilinear.

10. A device for packaging and applying the cosmetic, makeup or care product to the eyelashes and/or eyebrows, the device comprising an applicator according to claim 1 and a container containing the cosmetic, makeup or care product to be applied.

11. The applicator according to claim 1, wherein the axial offset between one longitudinal row of said double spikes and the adjacent longitudinal row is equal to about two fifths of the width of a double spike.

12. The applicator according to claim 1, wherein the two arms of the double spikes are of a same length.

13. The applicator according to claim 1, wherein the two arms of the double spikes are of a different length.

14. The applicator according to claim 1, wherein a height of the double spikes varies along the longitudinal axis of the core.

* * * * *